US005248006A

United States Patent [19]

Scott et al.

[11] Patent Number: 5,248,006

[45] Date of Patent: Sep. 28, 1993

[54] ROTARY ROCK BIT WITH IMPROVED DIAMOND-FILLED COMPACTS

[75] Inventors: Danny E. Scott; Stephen R. Jurewicz, both of Houston, Tex.

[73] Assignee: Baker Hughes Incorporated, Houston, Tex.

[21] Appl. No.: 881,731

[22] Filed: May 7, 1992

Related U.S. Application Data

[62] Division of Ser. No. 662,935, Mar. 1, 1991.

[51] Int. Cl.[5] ..... E21B 10/52

[52] U.S. Cl. ..... 175/420.2; 175/432; 175/434

[58] Field of Search ..... 175/420.2, 426, 428, 175/432, 434

[56] References Cited

U.S. PATENT DOCUMENTS

| | | | |
|---|---|---|---|
| 3,694,177 | 9/1972 | Vereschagin et al. . | |
| 4,073,354 | 2/1978 | Rowley et al. . | |
| 4,109,737 | 8/1978 | Bovenkerk . | |
| 4,140,189 | 2/1979 | Garner . | |
| 4,148,368 | 4/1979 | Evans . | |
| 4,164,527 | 8/1979 | Bakul et al. . | |
| 4,221,270 | 9/1980 | Vezirian . | |
| 4,246,977 | 1/1981 | Allen . | |
| 4,248,606 | 2/1981 | Bovenkerk et al. . | |
| 4,260,397 | 4/1981 | Bovenkerk . | |
| 4,268,276 | 5/1981 | Bovenkerk . | |
| 4,339,009 | 7/1982 | Bushy | 175/374 |
| 4,370,149 | 1/1983 | Hara et al. . | |
| 4,373,593 | 2/1983 | Phaal et al. . | |
| 4,380,471 | 4/1983 | Lee et al. . | |
| 4,431,065 | 2/1984 | Andrews . | |
| 4,457,765 | 7/1984 | Wilson . | |
| 4,531,595 | 7/1985 | Housman . | |
| 4,627,503 | 12/1986 | Horton | 175/420.2 |
| 4,764,255 | 8/1988 | Fischer et al. . | |

FOREIGN PATENT DOCUMENTS

| | | | |
|---|---|---|---|
| 118127 | 9/1984 | European Pat. Off. | 175/428 |
| 473813 | 9/1975 | U.S.S.R. | 175/428 |
| 2138864 | 10/1984 | United Kingdom | 175/434 |

*Primary Examiner*—William P. Neuder

*Attorney, Agent, or Firm*—Felsman, Bradley, Gunter & Dillon

[57] ABSTRACT

In an improved earth boring bit of the type having one or more rotable cones secured to bearing shafts, an improved cutting structure having diamond filled compacts used as a wear resistant inserts. The improved compacts have hard metal jackets and integrally formed diamond cores. The improved compacts are advantageously used as gage and heel row compacts when inserted in mating recesses provided on the exteriors of the rotatable cones.

19 Claims, 4 Drawing Sheets

ROTARY ROCK BIT WITH IMPROVED DIAMOND-FILLED COMPACTS

This application is a division of application Ser. No. 07/662,935, filed Mar. 1, 1991.

BACKGROUND OF THE INVENTION

1. Cross-Reference to Related Applications

This application is related to the co-pending application of Danny Eugene Scott and Stephen R. Jurewicz entitled IMPROVED ROCK BIT COMPACT AND METHOD OF MANUFACTURE and to the co-pending application of Steven R. Jurewicz entitled FIXED CUTTER BIT WITH IMPROVED DIAMOND FILLED COMPACTS, filed concurrently herewith.

2. Field of the Invention

The present invention relates generally to earth boring bits of the rolling cutter type and to improvements in gage and heel row compacts for such bits by which the resistance to wear is increased, the improved compacts being formed with a hard metal jacket and an integrally formed, diamond filled core.

3. Description of the Prior Art

Wear resistant inserts or compacts are utilized in a variety of earth boring tools where the inserts form rock cutting, crushing, chipping or abrading elements. In rotary well drilling, some geological formations are drilled with bits having cutting structures of wear resistant (usually sintered tungsten carbide) compacts held in receiving apertures in rotatable cones. In such bits, there is usually on each cone a group of cylindrical compacts that define a circumferential heel row that removes earth at the corner of the bore hole bottom. Further, it is common to insert additional cylindrical compacts, called "gage" compacts, on a "gage" surface that intersects a generally conical surface that receives the heel row compacts. These gage compacts protect the gage surfaces to prevent erosion of the metal of the cones that supports the heel row compacts. As a result, fewer heel compacts are lost during drilling and the original diameter of the bit is better maintained due to decreased wear. Moreover, the gage compacts also ream the hole to full "gage" after the heel compacts are worn to an undersized condition.

Fixed cutter bits, either steel bodied or matrix, are also utilized in drilling certain types of geological formations effectively. While these bits do not feature rotatable cones, they also have wear resistant inserts advantageously positioned in the "shoulder" or "gage" regions on the face of the bit which are essential to prolong the useful life of the bit.

A typical prior art wear resistant insert was manufactured of sintered tungsten carbide, a composition of mono and/or ditungsten carbide cemented with a binder typically selected from the iron group, consisting of cobalt, nickel or iron. Cobalt generally ranged from about 6 to 16% of the binder, the balance being tungsten carbide. The exact composition depended upon the usage intended for the tool and its inserts.

In recent years, both natural and synthetic diamonds have been used, in addition to tungsten carbide compacts, as cutting inserts on rotary and fixed cutter rock bits. In fact, it has long been recognized that tungsten carbide as a matrix for diamonds has the advantage that the carbide itself is wear resistant and offers prolonged matrix life. U.S. Pat. No. 1,939,991 to Krusell describes a diamond cutting tool utilizing inserts formed of diamonds held in a medium such as tungsten carbide mixed with a binder of iron, cobalt, or nickel.

In some prior art cutting tools, the diamond component of the tool was formed by the conversion of graphite to diamond. U.S. Pat. No. 3,850,053 describes a technique for making cutting tool blanks by placing a graphite disk in contact with a cemented tungsten carbide cylinder and exposing both simultaneously to diamond forming temperatures and pressures. U.S. Pat. No. 4,259,090 describes a technique for making a cylindrical mass of polycrystalline diamond by loading a mass of graphite into a cup-shaped container made from tungsten carbide and diamond catalyst material. The loaded assembly is then placed in a high temperature and pressure apparatus where the graphite is converted to diamond. U.S. Pat. No. 4,525,178 shows a composite material which includes a mixture of individual diamond crystals and pieces of precemented carbide.

U.S. Pat. No. 4,148,368 shows a tungsten carbide insert for mounting in a rolling cone cutter which includes a diamond insert embedded in a portion of the work surface of the tungsten carbide cutting insert in order to improve the wear resistance thereof. Various other prior art techniques have been attempted in which a natural or synthetic diamond insert was utilized. For instance, there have been attempts in the prior art to press-fit a natural or synthetic diamond within a jacket, with the intention being to engage the jacket containing the diamond within an insert receiving opening provided on the bit face or cone. These attempts were not generally successful since the diamonds tended to fracture or become dislodged in use.

There continues to exist a need for improvements in compacts of the type utilized as wear resistant inserts in earth boring bits, particularly in the gage and heel regions of rolling cone bits, which will improve the useful life of such bits.

A need also exists for improvements in the wear resistant inserts used in such bits, whereby such inserts are provided with improved abrasion resistance and diamond retention characteristics.

SUMMARY OF THE INVENTION

The improved rolling cone bits of the invention utilize diamond filled compacts as wear resistant inserts on the rotatable cones thereof. The diamond filled compacts have outer, generally cylindrical hard metal jackets and an inner core of integrally formed polycrystalline diamond. The compacts also preferably have an exposed, top surface at least 75% of which is exposed polycrystalline diamond. The thickness of the hard metal jacket is no greater than ½ the radius of the diamond cylinder core since the diamond is not utilized to strengthen or reinforce a tungsten carbide work surface, but instead substantially makes up the work surface itself.

The compacts are manufactured by placing a diamond powder within a hard metal jacket provided as either a cup or cylinder. The loaded jacket is then capped and placed into a high temperature and pressure apparatus and exposed to diamond sintering conditions to sinter the diamond grains into a raw blank comprised of a cord of integrally formed polycrystalline diamond surrounded by the hard metal jacket. The resulting blank can then be removed from the apparatus and shaped to form a compact having a variety of cutting forms.

Preferably, a generally cylindrical, hard metal jacket is provided having at least one initially open end and an open interior. The open interior preferably has an internal diameter which is at least 5% greater than the final required diameter. The cylindrical jacket also has an initial thickness which is preferably twice as thick as the final thickness required for the finished compact. The interior of the jacket is substantially filled with diamond powder and the initially open end of the jacket is covered with a cap. The diamond filled jacket is then subjected to a temperature and pressure sufficient to sinter the diamond powder. The outer diameter of the jacket is then reduced by finally sizing the outer diameter to a size selected to conform to the cutting insert pocket provided on the drill bit. By utilizing the compacts in insert receiving pockets provided in the gage row of the rotatable cutter, resistance to gage wear is increased and the useful life of the bit is increased.

Additional objects, features and advantages will be apparent in the written description which follows.

DETAILED DESCRIPTION OF THE INVENTION

Figure 1:
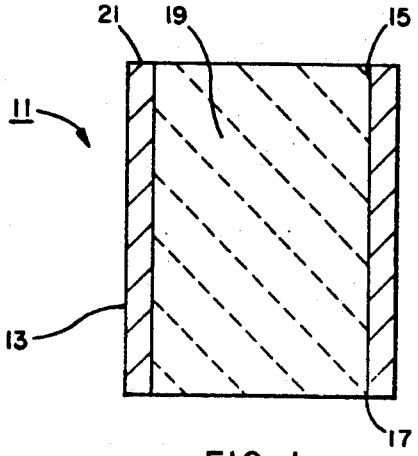
FIG. 1 is a side, cross-sectional view of an improved compact used in the earth boring bit of the invention prior to shaping or chamfering, the compact having oppositely arranged, exposed diamond surfaces.
Figure 2:
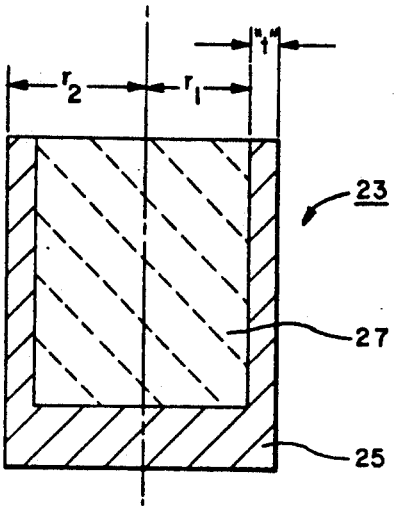
FIG. 2 is a cross-sectional view similar to FIG. 1 of a compact having an extra base layer of metal and an oppositely arranged, exposed diamond surface.

FIGS. 1 and 2 are cross-sectional views of raw blanks of the type which can be shaped to form, for instance, gage, heel and inner row compacts used in the practice of the invention. The blank 11 shown in FIG. 1 includes an outer, generally cylindrical jacket 13 which, in this case, has initially open ends 15, 17. Preferably, the jacket 13 is formed of a suitable metal or sintered carbide which will be referred to as a "hard metal jacket" for purposes of this description.

Although a sintered carbide, such as tungsten carbide is the preferred hard metal for the jacket material, it will be understood that other carbides, metals and metal alloys can be utilized as well. For instance, other possible jacket materials include INVAR, cobalt alloys, silicon carbide alloys and the like. As will be further explained, the purpose of the jacket 13 in the present method is to facilitate later machining and shaping of the compact and to facilitate insertion of the compact into a cutting insert pocket on a drill bit. Since the jacket 13 is not the primary work surface of the compact, it is not a requirement of the present invention that the jacket be formed of tungsten carbide.

The compact 11 has an inner core 19 of integrally formed polycrystalline diamond, the polycrystalline diamond comprising at least about 10%, and preferably 50 to 75% or more by volume of the compact 11. The compact has a top surface 21, which comprises the work surface of the compact, at least 75% of which is exposed polycrystalline diamond. As will be explained, the polycrystalline diamond core 19 is formed by filling the hard metal jacket 13 with a diamond powder and by sintering the diamond in a high pressure high temperature apparatus for a time and to a temperature sufficient to sinter the diamond and integrally form the diamond core within the jacket 13.

The compact blank 23 of FIG. 2 is identical to the blank of FIG. 1 except that an additional layer of hard metal 25 is added to the base of the compact to give the compact a cup-like appearance and to provide room for additional machining during later shaping operations. In both cases, the cylindrical diamond core 27 has a radius "$r_1$" surrounded by a jacket having cylindrical sidewalls of a generally uniform thickness "t", the Jacket having a radius "$r_2$." The thickness of the jacket sidewalls "t" is preferably no greater than ½ the radius "$r_1$" of the cylindrical diamond core 19.

Figure 3:
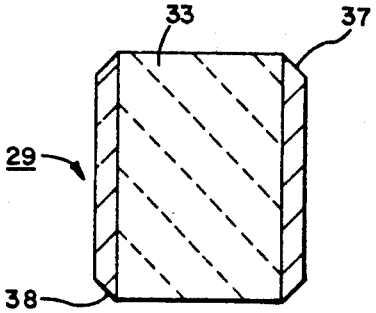
FIG. 3 is a cross-sectional view similar to FIG. 1 showing a gage compact with oppositely exposed diamond surfaces.
Figure 4:
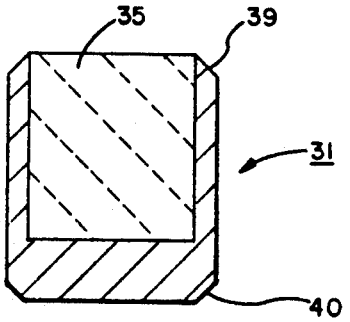
FIG. 4 is a view similar to FIG. 2 showing a gage compact with only one exposed diamond surface.

The compact blanks shown in FIGS. 1 and 2 can be shaped to form a variety of wear resistant inserts useful in earth boring tools. For instance, FIGS. 3 and 4 are cross-sectional views of gage row compacts formed by suitably shaping the blanks of FIGS. 1 and 2. The gage row compacts are characterized by flat, exposed diamond surfaces 33, 35 and also have chamfered top and bottom edges 37, 39 and 38, 40, respectively.

Figure 5:
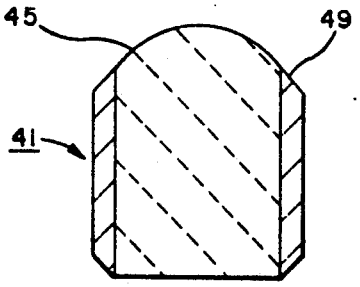
FIGS. 5-6 are similar to FIGS. 1-2 but illustrate heel row compacts having shaped upper extents.
Figure 6:
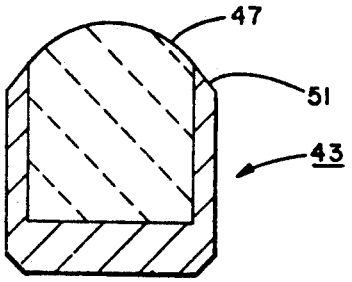

FIGS. 5 and 6 illustrate heel row compacts 41, 43 which feature generally arcuate upper extents 45, 47 and chamfered upper edges 49, 51.

Figure 7:
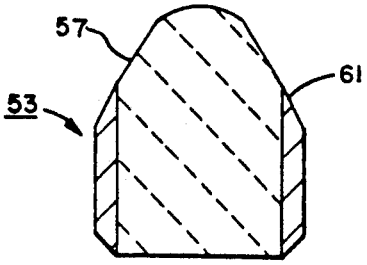
FIGS. 7-8 are similar to FIGS. 1-2 but show inner row compacts having shaped upper extents.
Figure 8:
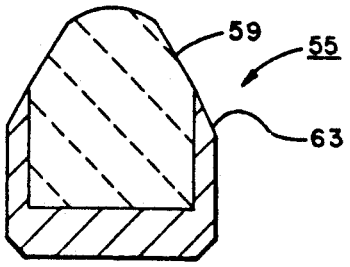

FIGS. 7 and 8 show inner row compacts 53, 55 which also feature chisel-shaped upper exposed diamond extents 57, 59 and chamfered top edges 61, 63.

Figure 11:
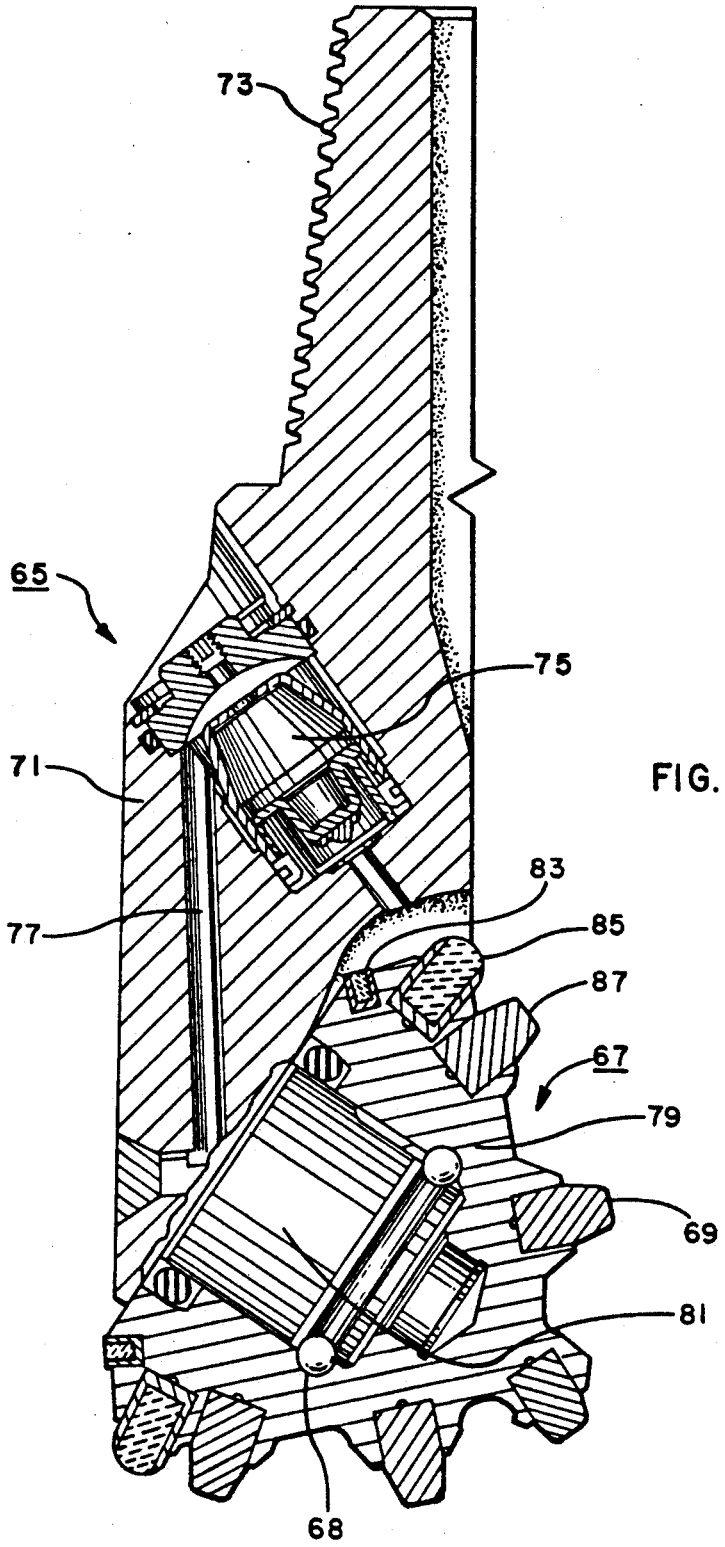
FIG. 11 is a side, partial cross-sectional view of a rolling cone rock bit of the type used to drill an earthen formation using the diamond filled compacts.
Figure 12:
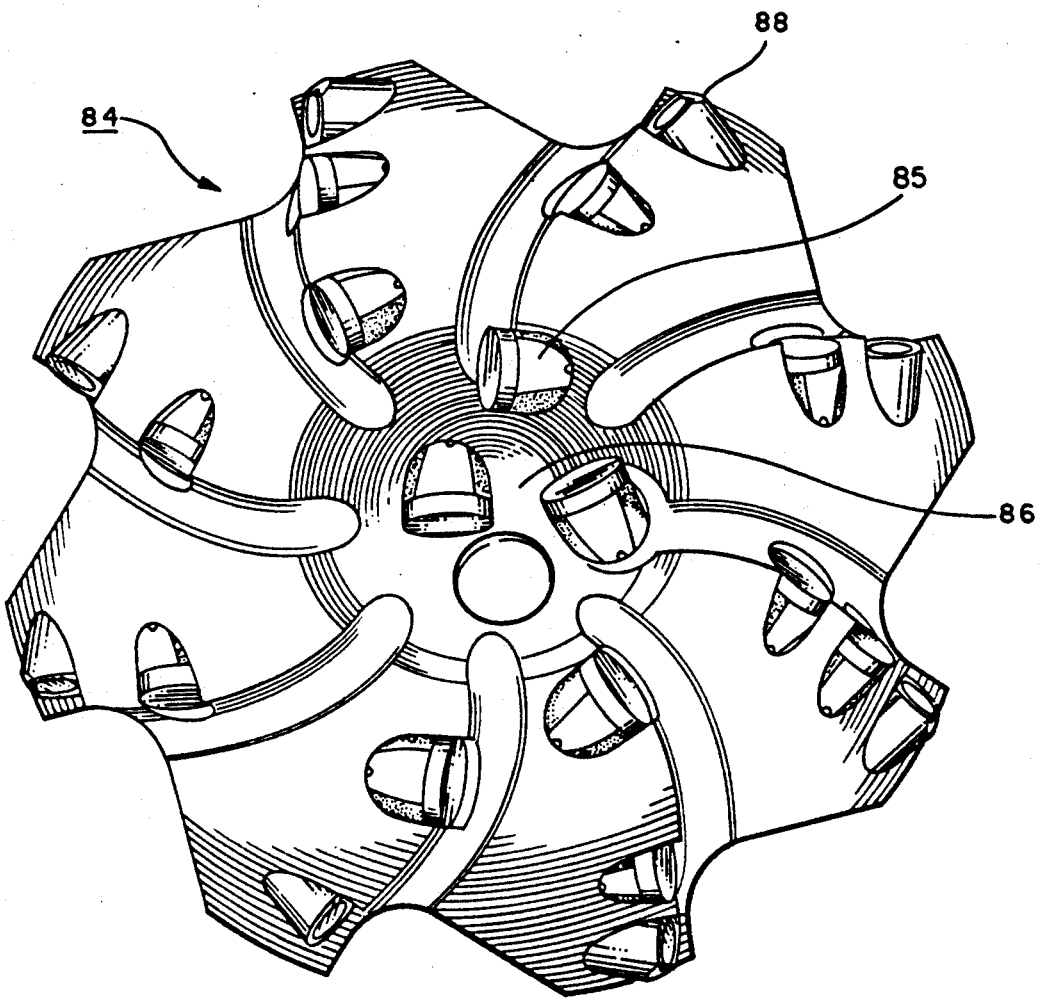
FIG. 12 is a top, plan view of a fixed cutter bit of the type used to drill an earthen formation utilizing the diamond filled compacts.

FIGS. 11 and 12 illustrate different types of earth boring drill bits which can utilize the improved compacts of the invention. FIG. 11 is a quarter sectional view of a rolling cone bit 65 typically provided with three rotatable cones, such as cone 67, each mounted on a bearing shaft 81 and having wear resistant inserts 69 used as earth disintegrating teeth. A bit body 71 has an upper end 73 which is externally threaded to be secured to a drill string member (not shown) used to raise and lower the bit in a well bore and to rotate the bit during drilling. The bit 65 will typically include a lubricating mechanism 75 which transmits a lubricant through one or more internal passages 77 to the internal friction surfaces of the cone 67 and have a retaining means 68 for retaining the cone 67 on the shaft 81.

The wear resistant inserts 69 which form the earth disintegrating teeth on the rolling cone bit 65 are arranged in circumferential rows, here designated by the numerals 83, 85 and 87, and referred to throughout the remainder of this description as the gage, heel and inner rows, respectively. These inserts were, in the past, typically formed of sintered tungsten carbide. The inserts illustrated as 83 and 85 in FIG. 11 feature the improved compacts of the invention.

FIG. 12 shows a portion of a typical fixed cutter drill bit, designated generally as 84, sometimes referred to as a "diamond bit." The diamond earth boring bits will be understood by those skilled in the art to include both steel bodied bits and "matrix" bits. The steel bodied bits are machined from a steel block and typically have cutting elements which are press-fit into openings provided in the bit face. The matrix bit is formed by coating a hollow tubular steel mandrel in a casting mold with metal bonded hard material, such as tungsten carbide. The casting mold is of a configuration which will give a bit of the desired form. The cutting elements are typically either polycrystalline diamond compacts cutters brazed within an opening provided in the matrix backing or are thermally stable polycrystalline diamond cutters which are cast within recesses provided in the matrix backing. The cutting inserts are often placed either in straight or spiraling rows extending from a central location 86 on the bit face out to the full bit diameter 88. Alternately, cutting elements are set in individual mountings placed strategically around the bit face.

Figure 10:
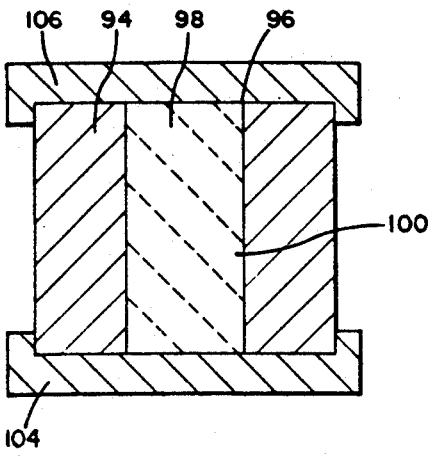
FIG. 10 is an isolated view of a raw blank fitted with end caps in the first step of the method used to form the improved compacts.
Figure 9:
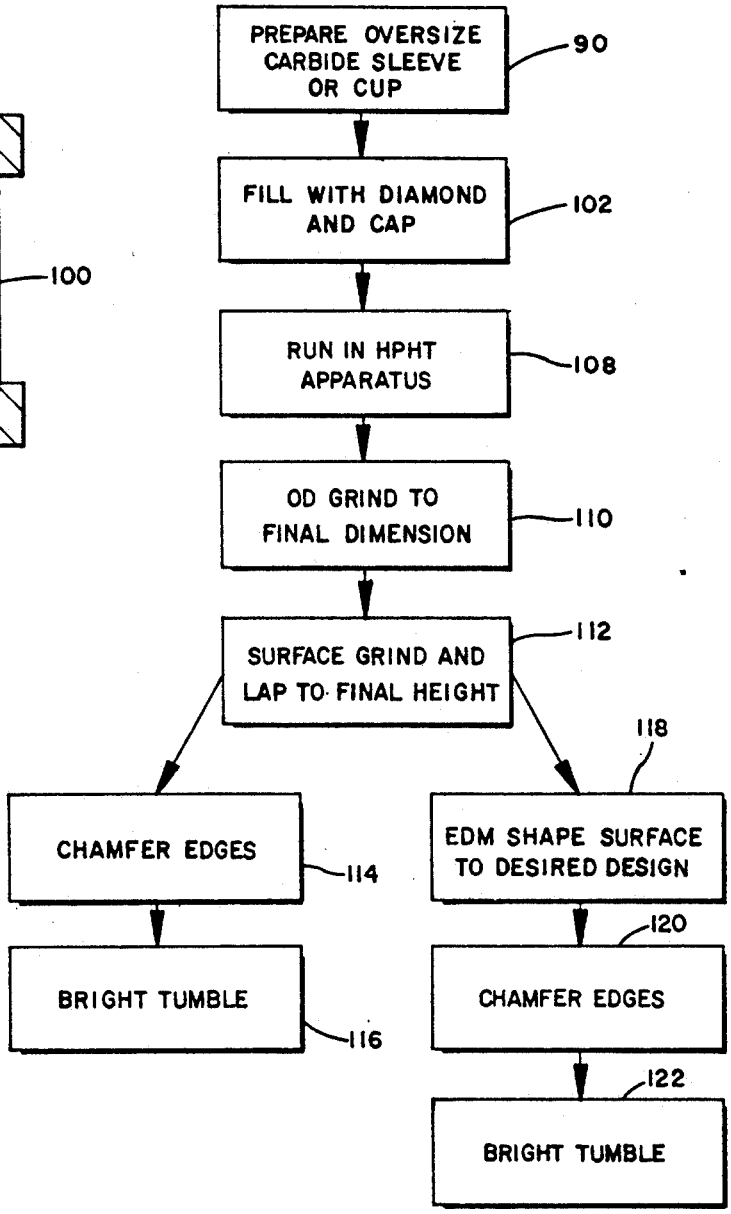
FIG. 9 is a flow diagram illustrating the steps in the method used to form the improved compacts which are used in the earth boring bits of the invention.

The method of forming the wear resistant inserts which are used in the drill bits of the invention will now be described with reference to the flow diagram shown in FIG. 9 and with reference to FIG. 10. In the first step of the method, illustrated as 90 in FIG. 9, a hard metal jacket 94 is formed having at least one initially open end 96 and an open interior 98. The open interior (98 in FIG. 10) is generally about 5% larger than the needed for the final dimension. The thickness of the jacket 94 in step 1 is also preferably twice as thick as that required in the final product. The hard metal jacket can conveniently be made from cemented tungsten carbide; other carbides, metals and metal alloys. For instance, the jacket can be formed from INVAR, cobalt alloys, silicon carbide alloys, and the like, as well as refractory metals such as Mo, Co, Nb, Ta, Ti, Zr, W, or alloys thereof.

The open interior 98 of the jacket is then substantially filled with a diamond powder 100 in a step 102. The diamond powder can conveniently be any diamond or diamond containing blend which can be subjected to high pressure and high temperature conditions to sinter the diamond material and integrally form a core of diamond material within the interior 98 of the surrounding jacket 94. For instance, the diamond material can comprise a diamond powder blend formed by blending together diamond powder and a binder selected from the group consisting of Ni, Co, Fe and alloys thereof, the binder being present in the range from about 0 to 10% by weight, based on the total weight of diamond powder blend. A number of diamond powders are commercially available including the GE 300 and GE MBS Series diamond powders provided by General Electric Corporation and the DeBeers SDA Series.

After filling the interior 98 of the hard metal jacket 94 with diamond powder blend, the jacket is fitted with tight fitting end caps 104, 106 and run in a high pressure high temperature apparatus in a step 108. The high pressure and temperature apparatus exposes the loaded jacket 94 to conditions sufficient to sinter the powdered diamond and integrally form a diamond core within a surrounding hard metal jacket.

Ultra high pressure and temperature cells are known in the art and are described, for instance, in U.S. Pat. Nos. 3,913,280 and 3,745,623 and will be familiar to those skilled in the art. These devices are capable of reaching conditions in excess of 40 kilobars pressure and 1,200° C. temperature.

In the next step 110 (FIG. 9) of the manufacturing method, the outside diameter of the hard metal jacket 94 is reduced to a size selected to conform to an insert receiving pocket provided on a drill bit, remembering that the hard metal jacket 94 was initially provided with a thickness preferably twice as thick as that required in the final product.

In the next step of the method 112, the compact is lapped, surface ground or electro discharge ground to provide a smooth top surface on the wear resistant insert and to achieve the final height desired. It will be understood by those skilled in the art that steps 110 and 112 could be interchanged in order.

For the gage row compacts (illustrated as FIGS. 3 and 4 and 83 in FIG. 11) the next step 114 is to grind the final chamfers on the top and bottom surfaces of the compact followed by bright tumbling in a step 116 to remove any sharp edges. The final gage row compact, as illustrated in FIGS. 3 and 4 has a basically planar top surface which is predominantly of exposed diamond material.

In the case of heel and inner row compacts, the next step after O.D. grinding and surface grinding is to shape the top surface to the desired final configuration in a step 118 using known machining techniques. The preferred shaping technique is Electro Discharge Machining (EDM) and can be used, e.g., to produce a heel row wear resistant insert having a dome or chisel shape. Standard EDM shaping techniques can be utilized in this step, such as those used in the manufacture of tungsten carbide dies and punches. After EDM shaping, the bottom surface of the compact may be chamfered in a step 120 and the part can be bright tumbled in a step 122 to complete the manufacturing operation.

An invention has been provided with several advantages. The method of the invention can be used to manufacture an improved earth boring bit which features novel diamond filled compacts as a wear resistant inserts. The wear resistant inserts utilized in the bits of the invention are provided as substantially all diamond material with only a thin jacket of hard metal to facilitate machining and mounting of the inserts in the drill bit face. By manufacturing compacts having only thin surrounding jackets of hard metal and substantially diamond filled cores, improved wear resistance and life can be obtained over standard tungsten carbide inserts or the diamond coated compacts of the past such as standard stud-mounted PDC inserts. The use of such inserts in the gage and heel rows of rolling cone bits has been found to extend the useful life of such bits.

While the invention has been shown in only one of its forms, it is not thus limited but is susceptible to various changes and modifications without departing from the spirit thereof.

I claim:

1. An improved earth boring bit having at least one rotatable cutter secured to a bearing shaft for boring a hole, the improvement comprising:

a plurality of spaced compacts, at least one of the spaced compacts being formed with a hard metal jacket and an integrally formed, diamond filled core, the compacts being mounted as wear resistant inserts on the face of the rotatable cutter, said at least one compact so formed being further characterized as having a top surface comprised of exposed diamond surrounded by a ring of jacket material and wherein at least 75% of the top surface of the compact is exposed diamond.

2. The improved earth boring bit of claim 1, wherein said at least one wear resistant insert so formed is in the shape of a cylindrical diamond core having a radius surrounded by a jacket having cylindrical sidewalls of a generally uniform thickness, the jacket thickness being no greater than one half the radius of the cylindrical diamond core.

3. The improved earth boring bit of claim 2, wherein the hard metal jackets are formed of a sintered metal carbide.

4. The improved earth boring bit of claim 3, wherein at least 10% by volume of each of the improved inserts is sintered diamond.

5. An improved earth boring bit of the type having rotatable cutters, each with a gage row defining a gage diameter of a hole being bored, the cutters being mounted rotatably on a shaft, the improvement comprising at least one wear resistant insert located at the gage row of at least one of the cutters, said wear resistant insert comprising a hard metal jacket and an integrally formed, diamond filled core, said at least one insert so formed being further characterized as having a top surface comprised of exposed diamond surrounded by a ring of jacket material and wherein at least 75% of the top surface of the compact is exposed diamond.

6. An improved earth boring bit of the type having rotatable cutters, each with a circumferential heel row of wear resistant inserts which remove earth at bottom corner of a borehole, the cutters being mounted rotatably on a shaft, the improvement comprising at least one wear resistant insert located at the heel row of at least one of the rotatable cutters, said wear resistant insert comprising a hard metal jacket and an integrally formed, diamond filled core, said at least one insert so formed being further characterized as having a top surface comprised of exposed diamond surrounded by a ring of jacket material and wherein at least 75% of the top surface of the compact is exposed diamond.

7. An improved earth boring bit of the type having rotatable cutters, each with a circumferential inner row of wear resistant inserts, the cutters being mounted rotatably on a shaft, the improvement comprising at least one wear resistant insert located at the inner row of at least one of the rotatable cutters, said wear resistant insert comprising a hard metal jacket and an integrally formed, diamond filled core, said at least one insert so formed being further characterized as having a top surface comprised of exposed diamond surrounded by a ring of jacket material and wherein at least 75% of the top surface of the compact is exposed diamond.

8. An improved earth boring bit of the type having at least one rotatable cutter which is rotatably mounted on a shaft, the improvement comprising a plurality of spaced compacts being mounted as wear resistant inserts on a face of the rotatable cutter, at least one of the spaced compacts being formed with a hard metal jacket and an integrally formed, diamond filled core, said at least one spaced compact so formed being further characterized as having a composition wherein sintered diamond is the majority by volume of the compact.

9. The improved earth boring bit of claim 8, wherein the hard metal jacket is formed of a sintered metal carbide.

10. The improved earth boring bit of claim 8, wherein the insert is further characterized as having a top surface comprised of exposed diamond surrounded by a ring of jacket material and wherein at least 75% of the top surface of the compact is exposed diamond.

11. The improved earth boring bit of claim 8, wherein the insert so formed is in the shape of a cylindrical diamond core having a radius surrounded by a jacket having cylindrical sidewalls of generally uniform thickness being no greater than one half the radius of the cylindrical diamond core.

12. An improved earth boring bit of the type having a at least one rotatable cutter which is rotatably mounted on a shaft, each cutter having an inner circumferential row of wear resistant inserts, the improvement comprising wear resistant inserts located in the inner circumferential row of wear resistant inserts, at least one of the inserts comprising a hard metal jacket and an integrally formed, diamond filled core, said at least one insert so formed being further characterized as having a composition wherein sintered diamond is at least the majority by volume of the compact.

13. The improved earth boring bit of claim 12, wherein the hard metal jacket is formed of a sintered metal carbide.

14. The improved earth boring bit of claim 12, wherein the insert is further characterized as having a top surface comprised of exposed diamond surrounded by a ring of jacket material and wherein at least 75% of the top surface of the compact is exposed diamond.

15. The improved earth boring bit of claim 12, wherein the insert so formed is in the shape of a cylindrical diamond core having a radius surrounded by a jacket having cylindrical sidewalls of generally uniform thickness being no greater than one half the radius of the cylindrical diamond core.

16. An improved earth boring bit of the type having at least one rotatable cutter rotatably mounted on a shaft, the cutter including a circumferential heel row of wear resistant inserts which remove earth at a bottom corner of the borehole, the improvement comprising at least one wear resistant insert located in the heel row of at least one of the rotatable cutters comprising a hard metal jacket and an integrally formed, diamond filled core, said at least one insert so formed being further characterized as having a composition wherein sintered diamond is at least the majority by volume of the compact.

17. The improved earth boring bit of claim 16, wherein the hard metal jacket is formed of a sintered metal carbide.

18. The improved earth boring bit of claim 16, wherein the insert is further characterized as having a top surface comprised of exposed diamond surrounded by a ring of jacket material and wherein at least 75% of the top surface of the compact is exposed diamond.

19. The improved earth boring bit of claim 16, wherein the insert so formed is in the shape of a cylindrical diamond core having a radius surrounded by a jacket having cylindrical sidewalls of generally uniform thickness being no greater than one half the radius of the cylindrical diamond core.

* * * * *

UNITED STATES PATENT AND TRADEMARK OFFICE

CERTIFICATE OF CORRECTION

PATENT NO. : 5,248,006

DATED : September 28, 1993

INVENTOR(S) : Danny E. Scott and Stephen R. Jurewicz

It is certified that error appears in the above-identified patent and that said Letters Patent is hereby corrected as shown below:

At column 2, line 64, replace "cord" with --core--.

At column 5, line 15, replace "compacts" with --compact--.

At column 6, line 42, replace "a wear" with --wear--.

Signed and Sealed this

Twenty-fourth Day of May, 1994

Bruce Lehman

*Attest:*

BRUCE LEHMAN

*Attesting Officer*

*Commissioner of Patents and Trademarks*